US011118431B2

(12) United States Patent
Lau et al.

(10) Patent No.: US 11,118,431 B2
(45) Date of Patent: Sep. 14, 2021

(54) SMART SAND CONTROL SERVICE TOOL POSITIONING

(71) Applicant: Chevron U.S.A. Inc., San Ramon, CA (US)

(72) Inventors: Quentin Bee Hing Lau, Sugar Land, TX (US); Cole Thomas Brinkley, Los Lunas, NM (US)

(73) Assignee: CHEVRON U.S.A. INC., San Ramon, CA (US)

( * ) Notice: Subject to any disclaimer, the term of this patent is extended or adjusted under 35 U.S.C. 154(b) by 9 days.

(21) Appl. No.: 16/696,856

(22) Filed: Nov. 26, 2019

(65) Prior Publication Data

US 2020/0165906 A1 May 28, 2020

Related U.S. Application Data

(60) Provisional application No. 62/772,484, filed on Nov. 28, 2018.

(51) Int. Cl.

| | |
|---|---|
| ***E21B 43/04*** | (2006.01) |
| ***E21B 47/12*** | (2012.01) |
| ***E21B 43/08*** | (2006.01) |
| ***E21B 47/092*** | (2012.01) |

(52) U.S. Cl.

CPC ..... *E21B 43/045* (2013.01); *E21B 43/08* (2013.01); *E21B 47/092* (2020.05); *E21B 47/12* (2013.01)

(58) Field of Classification Search

CPC ..... E21B 43/045; E21B 43/08; E21B 47/092; E21B 47/12

See application file for complete search history.

(56) References Cited

U.S. PATENT DOCUMENTS

| | | | | |
|---|---|---|---|---|
| 4,219,773 | A | 8/1980 | Markfelt | |
| 4,854,164 | A * | 8/1989 | Rhoads | E21B 47/10 73/152.29 |
| 9,726,004 | B2 | 8/2017 | Echols, III et al. | |
| 9,732,606 | B2 | 8/2017 | Frosell | |
| 2012/0043079 | A1* | 2/2012 | Wassouf | E21B 43/04 166/250.01 |
| 2017/0247960 | A1* | 8/2017 | Kyle | E21B 47/092 |
| 2018/0045036 | A1 | 2/2018 | Parlin | |
| 2020/0071898 | A1* | 3/2020 | Maher | E02B 17/0034 |

* cited by examiner

*Primary Examiner* — Dany E Akakpo
(74) *Attorney, Agent, or Firm* — King & Spalding LLP

(57) ABSTRACT

A system for determining positions of a sand control service tool includes a wash pipe positioned below the sand control service tool. The system further includes a sensor attached to the wash pipe. The system also includes one or more magnets attached to downhole completion equipment. The sensor is configured to generate position indicator information that indicates whether the one or more magnets are within a threshold distance from the sensor. A crossover port of the sand control service tool is positioned above a sand control packer when the one or more magnets are within the threshold distance from the sensor.

20 Claims, 13 Drawing Sheets

SMART SAND CONTROL SERVICE TOOL POSITIONING

CROSS REFERENCE TO RELATED APPLICATIONS

The present application claims priority under 35 U.S.C. Section 119(e) to U.S. Provisional Patent Application No. 62/772,484 filed Nov. 28, 2018 and titled "Smart Sand Control Service Tool Positioning," the entire content of which is incorporated herein by reference.

TECHNICAL FIELD

The present application is generally related to oil and gas operations, and in particular, to determining positions of a sand control service tool in a wellbore.

BACKGROUND

In the petroleum industry, a hydrocarbon sandstone reservoir can produce numerous sizes of formation sand. Formation sand that enters into the wellbore can be damaging to the wellbore, downhole completion equipment, surface equipment, and surface facilities. One method of controlling formation sand production is to introduce proppant and sand screen to prevent or limit sand production. The use of downhole sand screen and pumping proppant, which generally is referred to as sand control, requires the use of a sand control service tool and downhole completion equipment that includes sand screen, blank pipes, an isolation valve, a sand control tool housing, and a sand control packer. The service tool is used to lower the downhole completion equipment to a target depth of a wellbore and to place the sand screen across the sandstone reservoir. The service tool may also be used to physically activate the sand control packer that anchors the downhole completion equipment in place. Further, the sand control service tool provides a flow path for a gravel pack or frac pack treatment from the surface (e.g., a drillship) to the reservoir. After slurry is pumped down into a wellbore through the service tool and a crossover port of the service tool, the service tool is raised from a circulating position to a reverse position such that the crossover port is above the sand control packer. The circulating position may correspond to the position of the sand control service tool in relation to the completion equipment such that there exist a gravel pack/frac pack flow path from surface to the reservoir. This flow path travels through the workstring, exits through the sand control service tool cross over ports, through the sand control tool housing and to the reservoir. The reverse position may correspond to the position of the sand control service tool in relation to the completion equipment such that the sand control tool cross over port is above the sand control packer and the reservoir is isolated. The flow path is the casing/workstring annulus from the surface through the crossover port and up the workstring internal diameter (ID). In some applications, reliably determining and maintaining the position of the service tool in a wellbore may be challenging. For example, in floating rig applications, wave and tidal movements can interfere with the ability to reliably know and maintain the position of the service tool, which can lead to completion failure and other challenges. Thus, a solution that enables reliably determining the position of the service tool in a wellbore is desirable.

SUMMARY

The present application is generally related to oil and gas operations, and in particular, to determining positions of a sand control service tool in a wellbore. In an example embodiment, a system for determining positions of a sand control service tool includes a wash pipe positioned below the sand control service tool. There are several functions of a wash pipe including enabling an annular gravel pack from bottom to top of sand screens and carrying shifting tools, gauge carriers and logging tools. The system further includes a sensor attached to the wash pipe. The system also includes one or more magnets attached to downhole completion equipment. The sensor is configured to generate position indicator information that indicates whether the one or more magnets are within a threshold distance from the sensor. A crossover port of the sand control service tool is positioned above a sand control packer when the one or more magnets are within the threshold distance from the sensor.

In another example embodiment, a method of determining positions of a sand control service tool includes lowering the sand control service tool into a wellbore such that a crossover port of the sand control service tool is below a sand control packer positioned in the wellbore. The method further includes raising the sand control service tool. The method also includes determining, during or after the raising of the sand control service tool, whether the crossover port is above the sand control packer based on position indicator information provided by a sensor. The sensor is attached to a wash pipe that is below the sand control service tool. The position indicator information indicates whether one or more magnets attached to downhole completion equipment are within a threshold distance from the sensor. The crossover port is positioned above the sand control packer when the one or more magnets are within the threshold distance from the sensor.

In yet another example embodiment, a system for determining positions of a sand control service tool includes a wash pipe positioned below a sand control service tool, and a sensor attached to the wash pipe. The system further includes first one or more magnets attached to downhole completion equipment positioned around the wash pipe. The system also includes second one or more magnets attached to the downhole completion equipment below the first one or more magnets. The sensor is configured to detect a first magnetic force from the first one or more magnets, detect a second magnetic force from the second one or more magnets, and generate a position indicator that indicates whether the first one or more magnets are within a first threshold distance from the sensor and whether the second one or more magnets are within a second threshold distance from the sensor. A crossover port of the sand control service tool is positioned above a sand control packer when the first one or more magnets are within the first threshold distance from the sensor. The crossover port of the sand control service tool is positioned below the sand control packer when the second one or more magnets are within the second threshold distance from the sensor.

These and other aspects, objects, features, and embodiments will be apparent from the following description and the appended claims.

BRIEF DESCRIPTION OF THE DRAWINGS

Reference will now be made to the accompanying drawings, which are not necessarily drawn to scale, and wherein.

Figure 1:
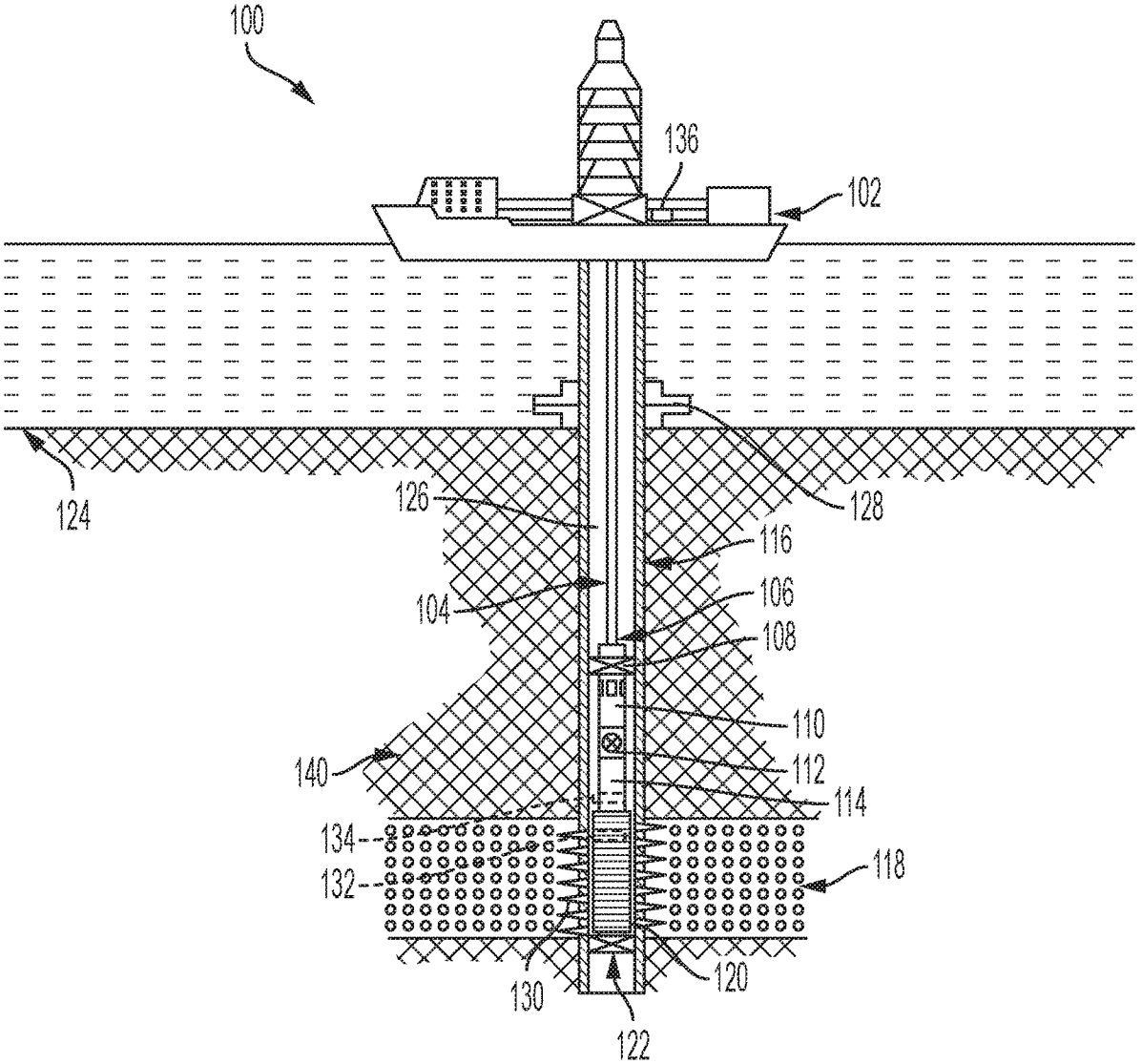
FIG. 1 illustrates an offshore oil and gas operation system including a system for determining a position of a sand control service tool according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Some features may be omitted from some of the drawings for clarity. Additionally, certain dimensions or placements may be exaggerated to help visually convey such principles. In the drawings, the same reference numerals used in different figures designate like or corresponding but not necessarily identical elements.

DETAILED DESCRIPTION OF THE EXAMPLE EMBODIMENTS

In the following paragraphs, particular embodiments will be described in further detail by way of example with reference to the drawings. In the description, well-known components, methods, and/or processing techniques are omitted or briefly described. Furthermore, reference to various feature(s) of the embodiments is not to suggest that all embodiments must include the referenced feature(s).

Turning now to the drawings, FIG. 1 illustrates an offshore oil and gas operation system 100 including a system for determining a position of a sand control service tool according to an example embodiment. In some example embodiments, the system 100 includes a drillship 102 at the sea surface. A workstring 104 extends down from the drillship 102 into a wellbore 126 drilled in the formation 140 below the sea floor 124. The workstring 104 extends down through a blowout preventer 128 that is located at the sea floor 124 above the wellbore 126. The workstring 104 is attached to a sand control service tool 106 that is partially positioned inside a service tool housing 110.

In some example embodiments, downhole completion equipment located in the wellbore 126 may include a blank pipe 114 that is positioned below the service tool housing 110. The downhole completion equipment may also include a sand control packer 108, attached to a sand control housing 110, attached to an isolation valve 112 that is attached to the blank pipes 114 and sand screens 120 below. (The phrase "sand screen" refers to one or more sand screens in this description hereinafter.) A sand control packer 108 is attached to a wellbore casing 116 and provides a pressure seal between the portions of the wellbore 126 above and below the sand control packer 108. The sand control packer 108 also serves as an anchor for other downhole completion equipment against tensional and compressional forces.

In some example embodiments, the sand screen 120 is positioned adjacent to a reservoir 118. The portion of the casing 116 at the reservoir 118 may have perforations 130 that provide fluid paths between the formation reservoir 118 and the wellbore 126. A sump packer 122 may be positioned below the sand screen 120. The sump packer 122 may be located a particular distance (e.g., 5 ft to 10 ft) below the bottom perforations 130, and can serve to locate the bottom end of the sand screen 120.

In some example embodiments, one or more magnets 132 may be attached to the sand screen 120. (The term "magnet" refers to one or more magnets in this description hereinafter.) For example, the magnet 132 may be annularly attached to the sand screen 120. As another example, the magnet 132 may be attached to less than a full annular portion of the sand screen 120. In some example embodiments, the magnet 132 may be attached on the outside of the sand screen 120. Alternatively, the magnet 132 may be attached on the inside of the sand screen 120. The magnet 132 may be attached to the sand screen 120 magnetically. Alternatively or in addition, the magnet 132 may be attached to the sand screen 120 using fasteners or other attachment means as can be understood by those of ordinary skill in the art with the benefit of this disclosure.

In some example embodiments, instead of or in addition to the magnet 132 that is attached to the sand screen 120, magnet 134 may be attached to the blank pipe 114. For example, the magnet 134 may be annularly attached to the blank pipe 114. As another example, the magnet 134 may be attached to less than a full annular portion of the blank pipe 114. In some example embodiments, the magnet 134 may be attached on the outside of the blank pipe 114. Alternatively, the magnet 134 may be attached on the inside of the blank pipe 114. The magnet 134 may be attached to the blank pipe 114 magnetically. Alternatively or in addition, the magnet 134 may be attached to the blank pipe 114 using fasteners or other attachment means as can be understood by those of ordinary skill in the art with the benefit of this disclosure.

Figure 2:
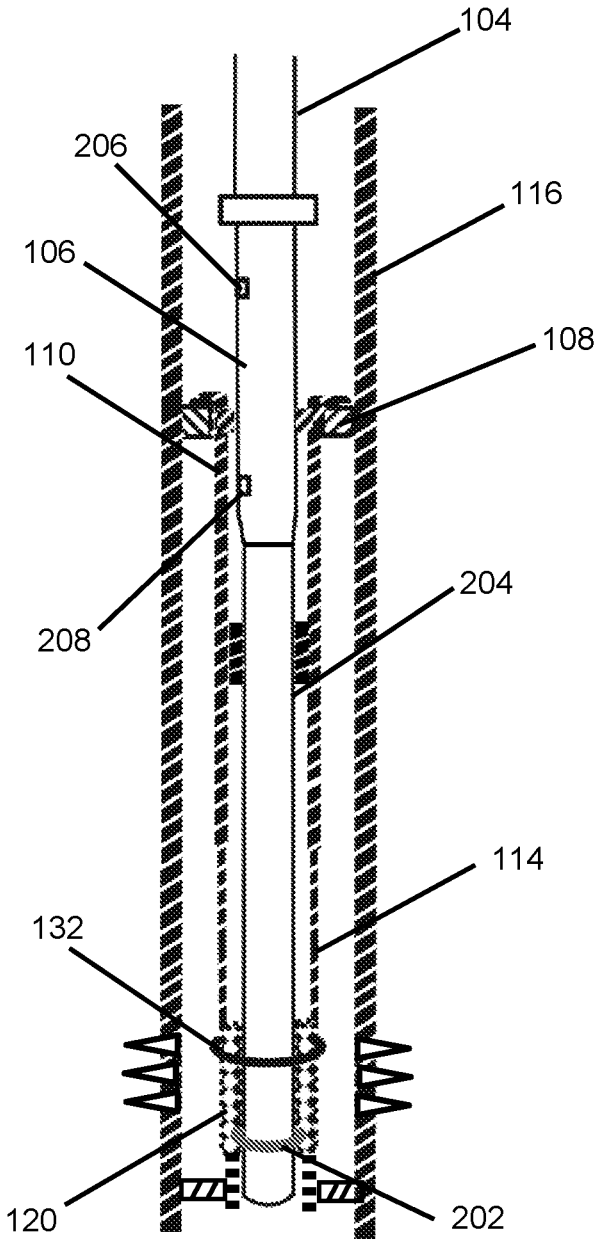
FIG. 2 illustrates a system for determining a position of a sand control service tool showing the sand control service tool in a circulating position according to an example embodiment.

In some example embodiments, a wash pipe may extend down from the sand control service tool 106, for example, as shown in FIG. 2. For example, a top end portion of the wash pipe may be attached to the sand control service tool 106 inside the service tool housing 110. The wash pipe may extend down through the blank pipe 114 and the sand screen 120 toward the sump packer 122. As explained in more detail below, a sensor (e.g., a sensor 202 shown in FIG. 2)

that senses a magnetic force from the magnet 132 and/or the magnet 134 may be attached to the wash pipe.

In some example embodiments, after the downhole completion equipment including the blank pipe 114 and the one or more sand control screens 120 have been placed in the wellbore 126, the sand control service tool 106 may be placed in a circulating position for the delivery of proppant to the annulus between the one or more sand control screens 120 and the portion of the casing 116 at the reservoir 118. The sand control service tool 106 may be lowered to the circulating position such that a crossover port of the sand control service tool 106 is below the sand control packer 108. To illustrate, the sand control service tool 106 may be lowered to the circulating position by lowering the workstring 104 at the drillship 102.

In some example embodiments, after the sand control service tool 106 is placed in the circulating position, slurry of a proppant may be pumped down from the drillship 102 through the workstring 104 and the sand control service tool 106. The slurry exits the sand control service tool 106 through the crossover port to the annulus between the one or more sand control screens 120 and the portion of the casing 116 at the reservoir 118. The proppant (e.g., gravel) in the slurry may remain in the annulus while the fluid that is used to deliver the proppant to the annulus returns back up through the sand control service tool 106 and enters the annulus between the workstring 104 and the casing 116 above the sand control packer 108 through a circulating port of the sand control service tool 106.

In some example embodiments, an operator at the drillship 102 may determine whether the sand control service tool 106 is in the circulating position in a manner known to those of ordinary skill in the art with the benefit of this disclosure. For example, the circulating position may be determined by lowering the sand control service tool 106 into the sand control housing 110. The service tool may have a collet profile that lands against a no-go profile such that the service tool 106 cannot pass through the no-go. Weight is set down by lowering the workstring 104 which is transferred to the sand control service tool 106. Since the service tool 106 is stopped by the no-go, a loss of weight at the surface as indicated by the string weight indicator indicates that the service tool is in the circulating position. Also the workstring 104 at surface is marked at the rotary table and the distance that the workstring 104 travels below the rotary table is measured.

In some example embodiments, after the pumping of the slurry into the annulus between the one or more sand control screens 120 and the portion of the casing 116 is completed, an operator at the drillship 102 may raise the sand control service tool 106 by raising the workstring 104. As described in more detail below, during a continuous or a step-wise raising of the sand control service tool 106, the sensor that is attached to the wash pipe may react to a magnetic force from the magnet 132 when the magnet 132 is within a threshold distance from the sensor and provide position indicator information that is provided to, for example, a computer 136 at the drillship 102. The operator at the drillship 102 may stop raising the sand control service tool 106 in response to receiving the position indicator information indicating that the magnet 132 is within a threshold distance from the sensor. For example, when the magnet 132 is within a threshold distance from the sensor, the sand control service tool 106 may be in a reverse position, where the crossover port of the sand control service tool 106 is above the sand control packer 108.

In some alternative embodiments, the magnet 132 may be omitted, and the sensor may react to a magnetic force from the magnet 134 in a similar manner as described with respect to the magnet 132. For example, when the magnet 134 is within a threshold distance from the sensor, the sand control service tool 106 may be in the reverse position, where the crossover port of the sand control service tool 106 is above the sand control packer 108.

In some alternative embodiments, the sensor may provide the position indicator information based on the magnet 132 as well as the magnet 134. For example, when the magnet 132 is within a threshold distance from the sensor, the crossover port of the sand control service tool 106 may still be below the sand control packer 108, and when the magnet 134 are within a threshold distance from the sensor, the sand control service tool 106 may be in the reverse position, where the crossover port of the sand control service tool 106 is above the sand control packer 108.

In some example embodiments, after the sand control service tool 106 is raised to the reverse position, a fluid may be pumped down the annulus between the workstring 104 and the casing 116 and return back up through the workstring 104. By providing a position indicator information that indicates whether the magnet 132 and/or the magnet 134 are within a threshold distance from a sensor, the operator at the drillship 102 can determine whether the sand control service tool 106 is in the reverse position and take subsequent action. For example, the operator can continue to raise the sand control service tool 106 until the sand control service tool 106 is in the reverse position. As another example, the operator may start pumping a fluid into the annulus between the workstring 104 and the casing 116 if the operator determines that the sand control service tool 106 has been raised to the reverse position.

Although a particular arrangement of components is shown in FIG. 1, in alternative embodiments, the system 100 may include different components and a different arrangement of components without departing from the scope of this disclosure. Although some components of the system 100 are shown as being directly connected, in alternative embodiments, the components may be indirectly connected without departing from the scope of this disclosure. In some alternative embodiments, one or more components of the system 100 may be omitted and/or other components may be included without departing from the scope of this disclosure. In some example embodiments, some components of the system 100 may be integrated into a single component. Although a vertical wellbore 126 is shown in FIG. 1, in alternative embodiments, the system 100 may be equally applicable to other types of wellbores. Although a drillship 102 is shown, other offshore and onshore platforms may be used without departing from the scope of this disclosure. Although the above description is presented with respect to the offshore system 100, in alternative embodiments, this specification including the above description may be applicable to onshore systems without departing from the scope of this disclosure. In some alternative embodiments, the wellbore 126 may have an open hole interval at the reservoir 118, where the portion of the casing 126 at the reservoir 118 and the perforations 130 may be omitted.

Figure 3:
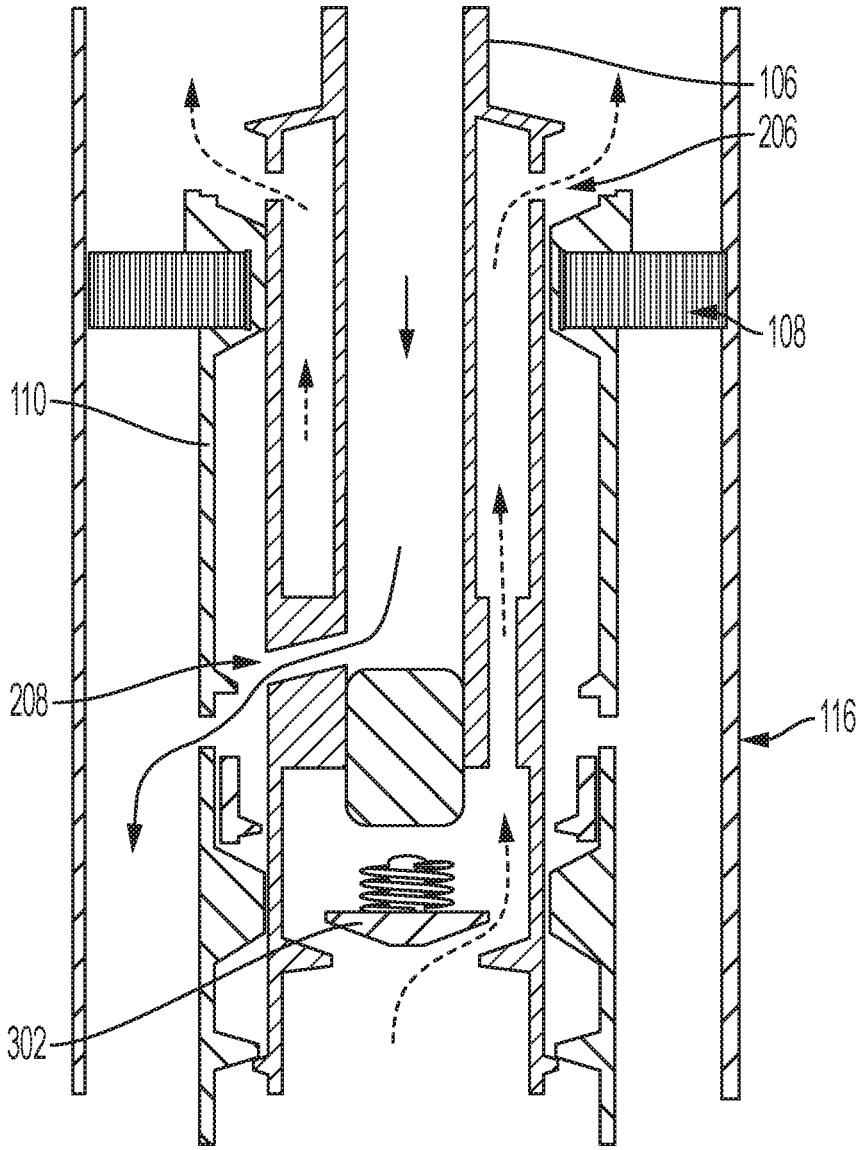
FIG. 3 shows an illustrative detailed view of the sand control service tool in the circulating position according to an example embodiment.

FIG. 2 illustrates a system for determining a position of the sand control service tool 106 showing the sand control service tool 106 in a circulating position according to an example embodiment. FIG. 3 shows an illustrative detailed view of the sand control service tool 106 in the circulating position according to an example embodiment. Referring to FIGS. 1-3, in some example embodiments, the workstring 104 is directly or indirectly attached to the sand control service tool 106. A portion of the sand control service tool 106 is positioned in the service tool housing 110. A wash pipe 204 is positioned below the sand control service tool 106. The wash pipe 204 may be directly or indirectly attached to the sand control service tool 106 such that the sand control service tool 106 and the wash pipe 204 move up or down together.

As shown in FIG. 2, a circulating port 206 of the sand control service tool 106 is located above the sand control packer 108 that is securely attached to the casing 116 providing a pressure seal between the portions of the wellbore 126 above and below the sand control packer 108. The crossover port 208 of the sand control service tool 106 is located below the sand control packer 108 allowing slurry to be pumped down through the workstring 104 and the sand control service tool 106 into the annulus between the sand screen 120 and the portion of the casing 116 at the reservoir 118.

In some example embodiments, the magnet 132 may be attached to the sand screen 120 that is below the blank pipe 114. For example, the magnet 132 may be attached annularly around the sand screen 120. The magnet 132 may be on the inside of the sand screen 120 or on the outside of the sand screen 120. In some alternative embodiments, the magnet 132 may have a non-annular shape without departing from the scope of this disclosure.

In some example embodiments, a sensor 202 is attached to the wash pipe 204. For example, the sensor 202 may have an annular shape and may be attached annularly to the wash pipe 204. Alternatively, the sensor 202 may be attached to the wash pipe 204 in a different manner. For example, the sensor 202 may have a non-annular shape without departing from the scope of this disclosure. When the sand control service tool 106 is in the circulating position as shown in FIG. 2, the magnet 132 is positioned above the sensor 202.

In some example embodiments, the sensor 202 may provide position indicator information that indicates whether the magnet 132 is within a threshold distance from the sensor 202. To illustrate, the sensor 202 is triggered by the magnetic force when the magnet 132 is within the threshold distance from the sensor 202. When the sensor 202 is triggered by the magnetic force from the magnet 132, a position indicator (e.g., an electrical current flowing in the reed switch) from the sensor 202 indicates that the sensor 202 is triggered (i.e., the position indicator indicates that the magnet 132 is within the threshold distance from the sensor 202). Indicating that the sensor is within the threshold distance from the magnet 132 corresponds to indicating that the crossover port of the sand control service tool 106 is above the sand control packer 108. When the sand control service tool 106 is in the circulating position, the magnet 132 is located outside of the threshold distance from the sensor 202, where the magnetic force from the magnet 132 is too weak to trigger the sensor 202. For the sake of clarity, when the magnet 132 is outside of a threshold distance from the sensor 202, the sensor 202 may still detect the magnetic force from the magnet 132 but is not triggered by the magnetic force.

In some example embodiments, the threshold distance may depend on a number of factors including the type of the magnet 132, the radial separation between the sand screen 120 and the wash pipe 204, the type of any enclosures of the sensor 202 and/or the magnet 132, etc. As a non-limiting example, the threshold distance may be reached when the non-aligned vertical separation of the sensor 202 and the magnet 132 is generally less than 6 inches.

As described above, when the sand control service tool 106 is in the circulating position, where the crossover port 208 is below the sand control packer 108, the magnet 132 is separated from the sensor 202 such that the magnetic force from the magnet 132 does not trigger the sensor 202. For example, when the sand control service tool 106 is in the circulating position, the magnet 132 may be spaced from the sensor 202 by a vertical distance that equals the distance that the sand control service tool 106 needs to be raised for the crossover port 208 to be at a desirable location above the sand control packer 108.

As described above, when the sand control service tool 106 is in the circulating position, slurry (e.g., slurry of a proppant such as gravel, etc.) may be pumped down through the workstring 104 and the sand control service tool 106 into the annulus between the sand screen 120 and the casing 116. For example, the proppant in the slurry may flow to the annulus between the screen 120 and the casing 116 (or the formation in embodiments where the casing is omitted at the reservoir 118). The fluid in the slurry may return back up from the annulus through the wash pipe 204 and the sand control service tool 106. As more clearly shown in FIG. 3, a valve 302 in the sand control service tool 106 is open allowing the fluid to flow upward through the sand control service tool 106. The fluid that flows up through the sand control service tool 106 enters the annulus between the casing 116 and the sand control service tool 106/the workstring 104 through the circulation port 206 above the sand control packer 108.

In some alternative embodiments, when the sand control service tool 106 is in the circulating position, the sand control service tool 106 may be located lower or higher than shown in FIGS. 2 and 3 with respect to the service tool housing 110 without departing from the scope of this disclosure. In some alternative embodiments, additional magnets that are vertically separated from each other may be used without departing from the scope of this disclosure. In some alternative embodiments, the sand control service tool 106 may have different design/structure than shown in FIGS. 2 and 3 without departing from the scope of this disclosure.

Figure 4:
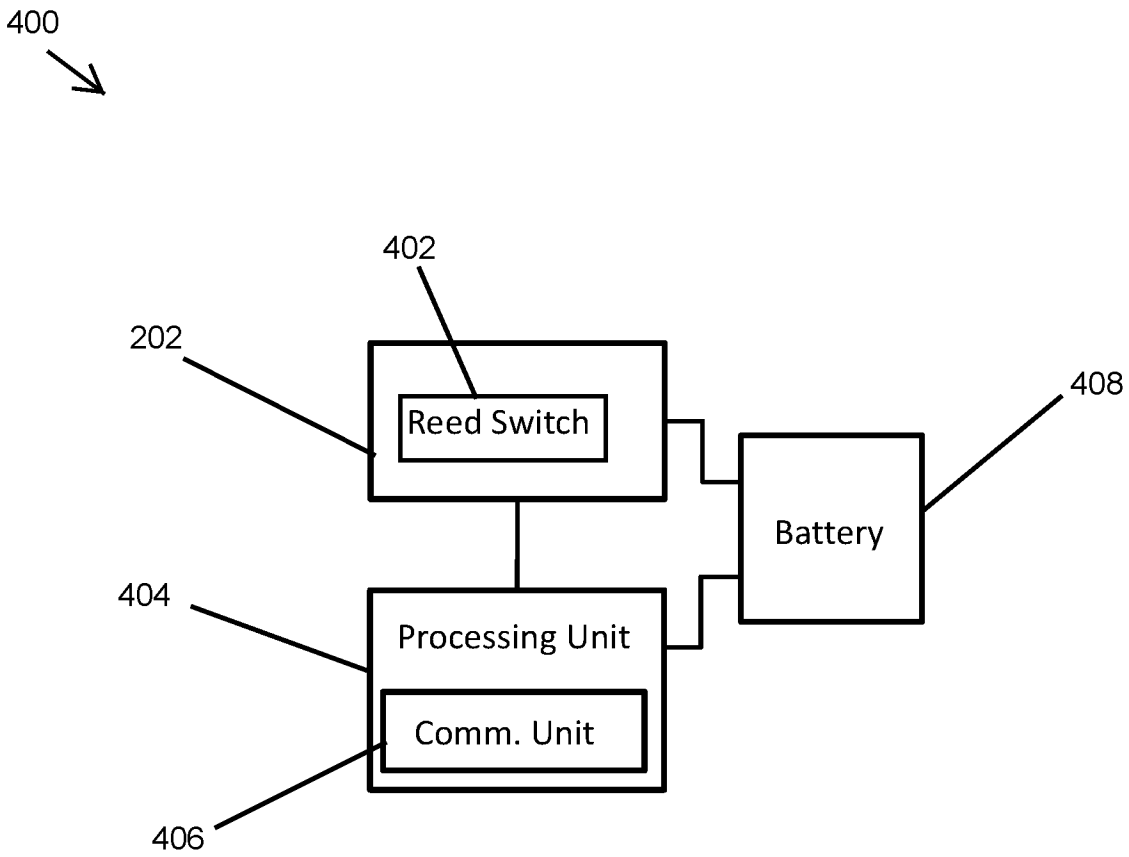
FIG. 4 illustrates a sensor and communication system according to an example embodiment.

FIG. 4 illustrates a sensor and communication system 400 according to an example embodiment. In some example embodiments, the system 400 includes the sensor 202 that includes a reed switch 402. The system 400 may also include a processing unit 404 that may include a communication unit 406. A battery 408 may provide a voltage to the processing unit 404. The battery 408 may also provide a voltage to the sensor 202.

Referring to FIGS. 1-4, in some example embodiments, the reed switch 402 is designed to react to a magnetic force that is strong enough to trigger the reed switch 402. For example, the reed switch 402 may be a normally open reed switch that closes when a strong enough magnetic force is present. To illustrate, when the magnet 132 is moved close enough to the sensor 202 (i.e., with the threshold distance), the magnetic force from the magnet 132 is strong enough to trigger (i.e., close) the reed switch 402. When the magnetic force is removed or has become weak enough, the reed switch 402 is designed to return to the open position.

As another example, the reed switch 402 may be a normally closed reed switch that opens when a strong enough magnetic force is present. To illustrate, when the magnet 132 is moved close enough to the sensor 202 (i.e., with the threshold distance), the magnetic force from the magnet 132 is strong enough to trigger (i.e., open) the reed switch 402. When the magnetic force is removed or has become weak enough, the reed switch 402 is designed to return to the closed position.

In some example embodiments, the sensor 202 may indicate to the processing unit 404 that the reed switch 402 has been triggered by the magnetic force from the magnet 132. To illustrate, the processing unit 404 may detect an open circuit or a short circuit on the electrical connection between the processing unit 404 and the sensor 202, which depends on whether the reed switch 402 is triggered. For example, the processing unit 404 may detect whether a particular voltage level is present on the connection between the processing unit 404 and the sensor 202, where the voltage level indicates that the reed switch 402 is triggered (i.e., the magnet 132 is within the threshold distance from the sensor 202). The absence of the particular voltage level may indicate that the magnet 132 is outside of the threshold distance from the sensor 202. For example, the presence or absence of a particular voltage level at the connection between the reed switch 402 and the processing unit 404 provides position indicator information that indicates whether the magnet 132 is within the threshold distance from the sensor 202.

In some example embodiments, the communication unit 406 may transmit the position indicator information from the sensor 202, for example, to the computer 136 at the drillship 102. For example, the communication unit 406 may transmit the position indicator information acoustically through the workstring 104 and other structural components of the system 100. The communication unit 406 may be located together with the sensor 202 or separately from the sensor 202.

In some alternative embodiments, the sensor 202 may include one or more other components (e.g., a resistor, etc.) without departing from the scope of this disclosure. In some example embodiments, the battery 408 may not provide a voltage to the sensor 202 without departing from the scope of this disclosure. In general, the processing unit 404 may detect an open circuit and/or closed circuit through the reed switch 402 in one of several ways known to those of ordinary skill in the art. In some alternative embodiments, some components of the sensor and communication system 400 may be integrated into a single component without departing from the scope of this disclosure.

Figure 5:
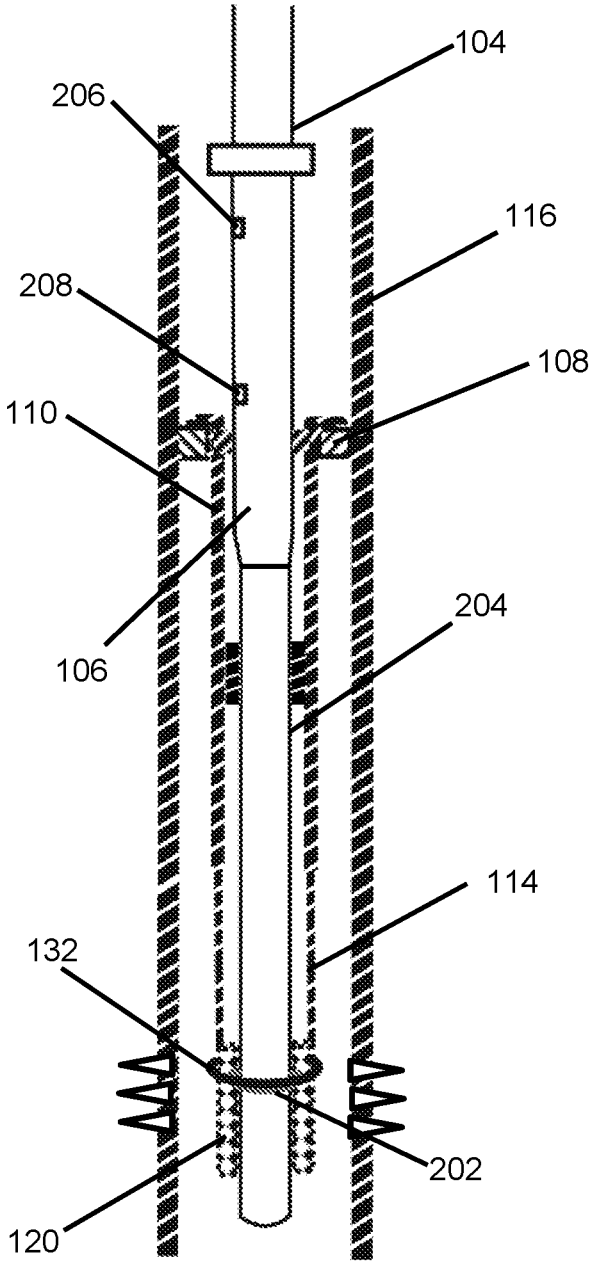
FIG. 5 illustrates the system for determining a position of a sand control service tool showing the sand control service tool in a reverse position according to an example embodiment.
Figure 6:
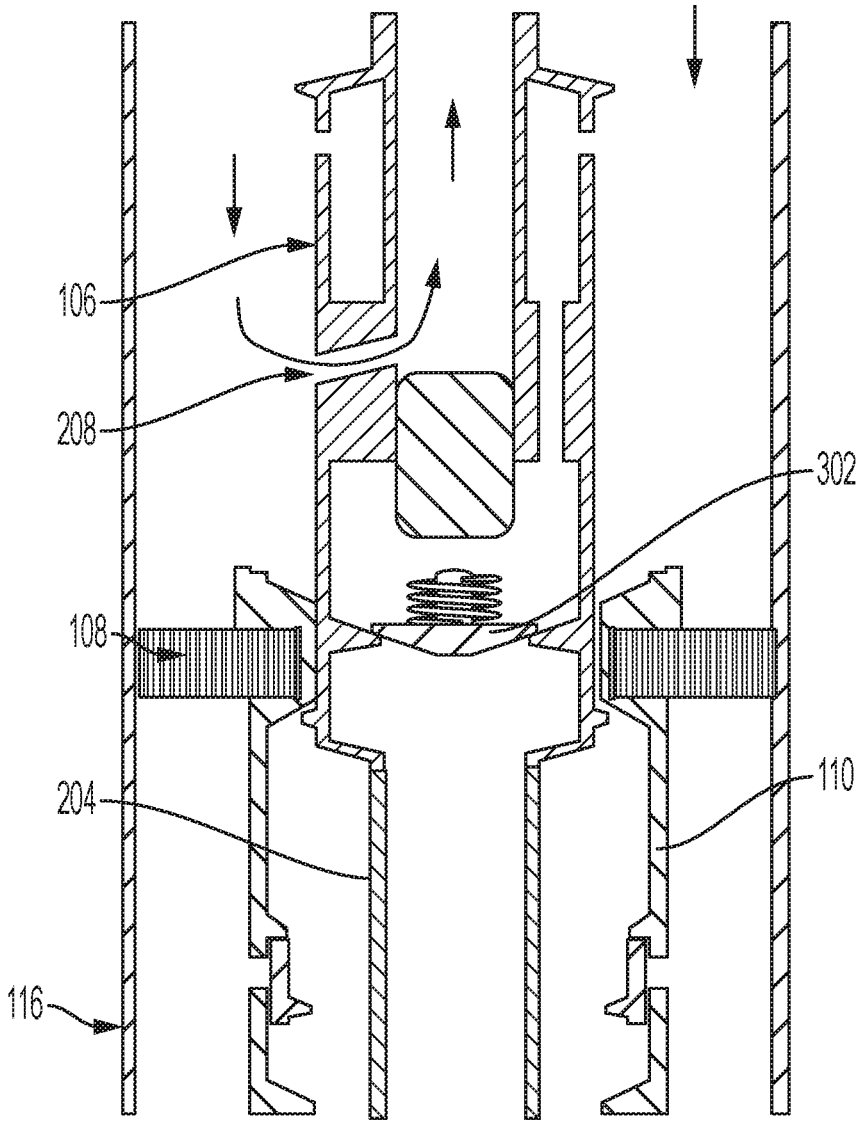
FIG. 6 shows an illustrative detailed view of the sand control service tool in the reverse position according to an example embodiment.

FIG. 5 illustrates the system for determining the position of the sand control service tool 106 showing the sand control service tool 106 in a reverse position according to an example embodiment. FIG. 6 shows an illustrative detailed view of the sand control service tool 106 in the reverse position according to an example embodiment. Referring to FIGS. 1, 5, and 6, a portion of the sand control service tool 106 is positioned in the service tool housing 110. In FIGS. 5 and 6, the crossover port 208 is located above the sand control packer 108 after the sand control service tool 106 has been raised to the reverse position from the circulating position shown in FIGS. 2 and 3. Because the wash pipe 204 is raised along with the sand control service tool 106, the sensor 202 has moved closer to the magnet 132 in contrast to the location of the sensor 202 shown in FIG. 2.

In some example embodiments, in FIGS. 5 and 6, the magnet 132 may be within the threshold distance from the sensor 202 such that the sensor 202 is triggered by the magnetic force from the magnet 132. As illustrated in FIG. 5, the sensor 202 may not be horizontally aligned with the magnet 132 for the magnet 132 to come within the threshold distance from the sensor 202. In some alternative embodiments, the sensor 202 may need to be substantially horizontally aligned with the magnet 132 for the magnet 132 to be within the threshold distance from the sensor 202 to trigger the sensor 202.

To illustrate, starting from the position of the sensor 202 shown in FIG. 2, the sand control service tool 106 along with the wash pipe 204 and the sensor 202 may be continuously raised by an operator at the drillship 102. When the sand control service tool 106 is raised such that the magnet 132 comes within the threshold distance from the sensor 202, the sensor 202 may send the position indicator information that indicates that the magnet 132 is within the threshold distance from the sensor 202. For example, a communication unit described below may transmit the position indicator information provided by the sensor 202. Indicating that the sensor 202 is within threshold distance from the magnet 132 corresponds to indicating that the crossover port 208 of the sand control service tool 106 is above the sand control packer 108. The operator at the drillship 102 may stop raising the sand control service tool 106 based on the position indicator information. In some alternative embodiments, the sand control service tool 106 along with the wash pipe 204 and the sensor 202 may be raised in steps until the position indicator information indicates that the magnet 132 is within the threshold distance from the sensor 202.

In some example embodiments, the position indicator information may indicate that the magnet 132 is outside of the threshold distance from the sensor 202. For example, the absence of position indicator information that indicates that the magnet 132 is within the threshold distance from the sensor 202 may be interpreted as indicating that the magnet 132 is outside of the threshold distance. Alternatively, the position indicator information may more directly indicate that the magnet 132 is outside of the threshold distance whenever the sensor 202 is not triggered.

In some example embodiments, after the determination is made that the crossover port 208 is at a desired location above the sand control packer 108 (i.e., the sand control service tool 106 is in the reverse position), a fluid may be pumped down in the annulus between the workstring 104 and the casing 116, where the fluid enters the workstring through the crossover port 208 of the sand control service tool 106. As more clearly shown in FIG. 6, the valve 302 is closed preventing the fluid from flowing down through the wash pipe 204.

In some alternative embodiments, when the sand control service tool 106 is in the reverse position, the sand control service tool 106 may be located lower or higher with respect to the service tool housing 110 than shown in FIGS. 5 and 6 without departing from the scope of this disclosure. In some alternative embodiments, the magnet 132 may be separated from the sensor 202 more or less than shown in FIG. 5 without departing from the scope of this disclosure.

Figure 7:
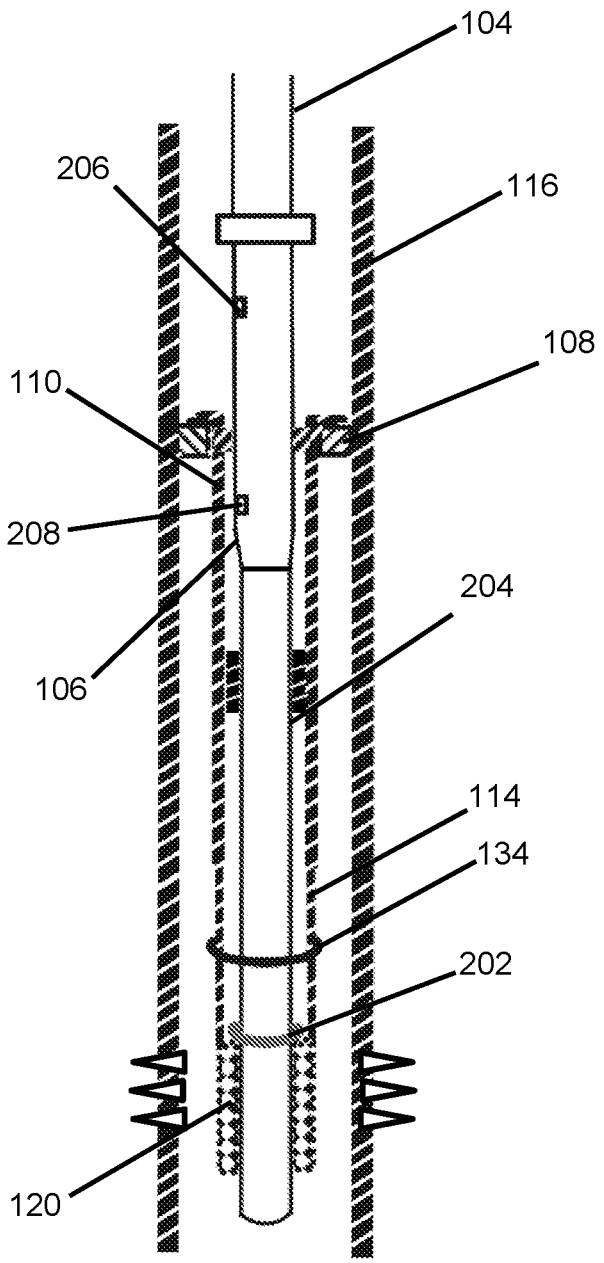
FIG. 7 illustrates a system for determining the position of the sand control service tool showing the sand control service tool in the circulating position according to another example embodiment.

FIG. 7 illustrates a system for determining the position of the sand control service tool 106 showing the sand control service tool in the circulating position according to another example embodiment. Referring to FIGS. 1 and 7, in some example embodiments, the magnet 134 is attached to the blank pipe 114 that is directly or indirectly attached to the service tool housing 110. As described above, the crossover port 208 of the sand control service tool 106 is below the sand control packer 108 when the sand control service tool 106 is in the circulating position.

In some example embodiments, the magnet 134 is positioned above the sensor 202 when the sand control service tool 106 is in the circulating position as shown more clearly in FIG. 7. The magnet 134 may be attached annularly around the blank pipe 114. The magnet 134 may be on the inside of the blank pipe 114 or on the outside of the blank pipe 114. In some alternative embodiments, the magnet 134 may have a non-annular shape without departing from the scope of this disclosure.

In some example embodiments, the sensor 202 is attached to the wash pipe 204 as described above. For example, the sensor 202 may have an annular shape and may be attached annularly to the wash pipe 204. Alternatively, the sensor 202 may be attached to the wash pipe 204 in a different manner. For example, the sensor 202 may have a non-annular shape without departing from the scope of this disclosure.

In some example embodiments, the sensor 202 and the magnet 134 operate in a similar manner as described above with respect to the sensor 202 and the magnet 132. To illustrate, when the sand control service tool 106 is in the circulating position, the magnet 134 may be spaced from the sensor 202 by a vertical distance that equals the distance that the sand control service tool 106 needs to be raised for the crossover port 208 to be at a desirable location above the sand control packer 108. When the sand control service tool 106 is in the circulating position, slurry that is pumped down through the workstring 104 and the sand control service tool 106 enters the annulus between the sand screen 120 and the casing 116 through the crossover port 208 in a similar manner as described above.

In some alternative embodiments, when the sand control service tool 106 is in the circulating position, the sand control service tool 106 may be located lower or higher with respect to the service tool housing 110 than shown in FIG. 7. In some alternative embodiments, the sensor 202 and the magnet 134 may be separated by more or less distance than shown without departing from the scope of this disclosure. In some alternative embodiments, additional one or more magnets that are vertically separated from each other may be used without departing from the scope of this disclosure.

Figure 8:
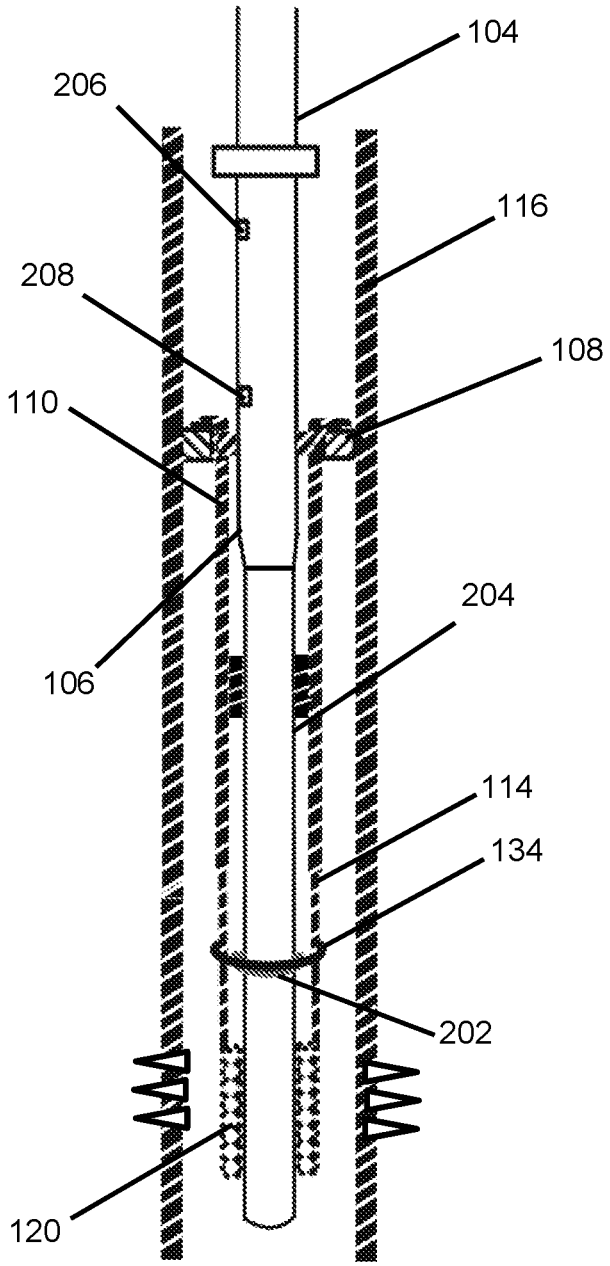
FIG. 8 illustrates the system of FIG. 7 with the sand control service tool in the reverse position according to another example embodiment.

FIG. 8 illustrates the system of FIG. 7 with the sand control service tool in the reverse position according to another example embodiment. Referring to FIGS. 1 and 8, a portion of the sand control service tool 106 is positioned in the service tool housing 110. In FIG. 8, the crossover port 208 is located above the sand control packer 108 after the sand control service tool 106 has been raised to the reverse position from the circulating position shown in FIG. 7. Because the wash pipe 204 is raised along with the sand control service tool 106, the sensor 202 has moved closer to the magnet 134 in contrast to the location of the sensor 202 shown in FIG. 7.

In some example embodiments, the magnet 134 may be within the threshold distance from the sensor 202 such that the sensor 202 is triggered by the magnetic force from the magnet 134. As illustrated in FIG. 8, the sensor 202 may not be horizontally aligned with the magnet 134 for the magnet 134 to come within the threshold distance from the sensor 202. In some alternative embodiments, the sensor 202 may need to be substantially horizontally aligned with the magnet 134 for the magnet 134 to be within the threshold distance from the sensor 202 and trigger the sensor 202.

To illustrate, starting from the position of the sensor 202 shown in FIG. 7, the sand control service tool 106 along with the wash pipe 204 and the sensor 202 may be continuously raised by an operator at the drillship 102. When the sand control service tool 106 is raised such that the magnet 134 comes within the threshold distance from the sensor 202, the sensor 202 may send the position indicator information that indicates that the magnet 134 is within the threshold distance from the sensor 202. Indicating that the sensor 202 is within threshold distance from the magnet 134 corresponds to indicating that the crossover port 208 of the sand control service tool 106 is above the sand control packer 108. The operator at the drillship 102 may stop raising the sand control service tool 106 based on the position indicator information. In some alternative embodiments, the sand control service tool 106 along with the wash pipe 204 and the sensor 202 may be raised in steps until the position indicator information indicates that the magnet 134 is within the threshold distance from the sensor 202.

In some example embodiments, the position indicator information may indicate that the magnet 134 is outside of the threshold distance from the sensor 202. For example, the absence of position indicator information that indicates that the magnet 134 is within the threshold distance from the sensor 202 may be interpreted as indicating that the magnet 134 is outside of the threshold distance. Alternatively, the position indicator information may more directly indicate that the magnet 134 is outside of the threshold distance whenever the sensor 202 is not triggered. In some example embodiments, after the determination is made that the crossover port 208 is at a desired location above the sand control packer 108 (i.e., the sand control service tool 106 is in the reverse position), subsequent operations may be performed in a similar manner as described above.

In some alternative embodiments, when the sand control service tool 106 is in the reverse position, the sand control service tool 106 may be located lower or higher with respect to the service tool housing 110 than shown in FIG. 8 without departing from the scope of this disclosure. In some alternative embodiments, the magnet 134 may be separated from the sensor 202 more or less than shown in FIG. 8 without departing from the scope of this disclosure.

Figure 9:
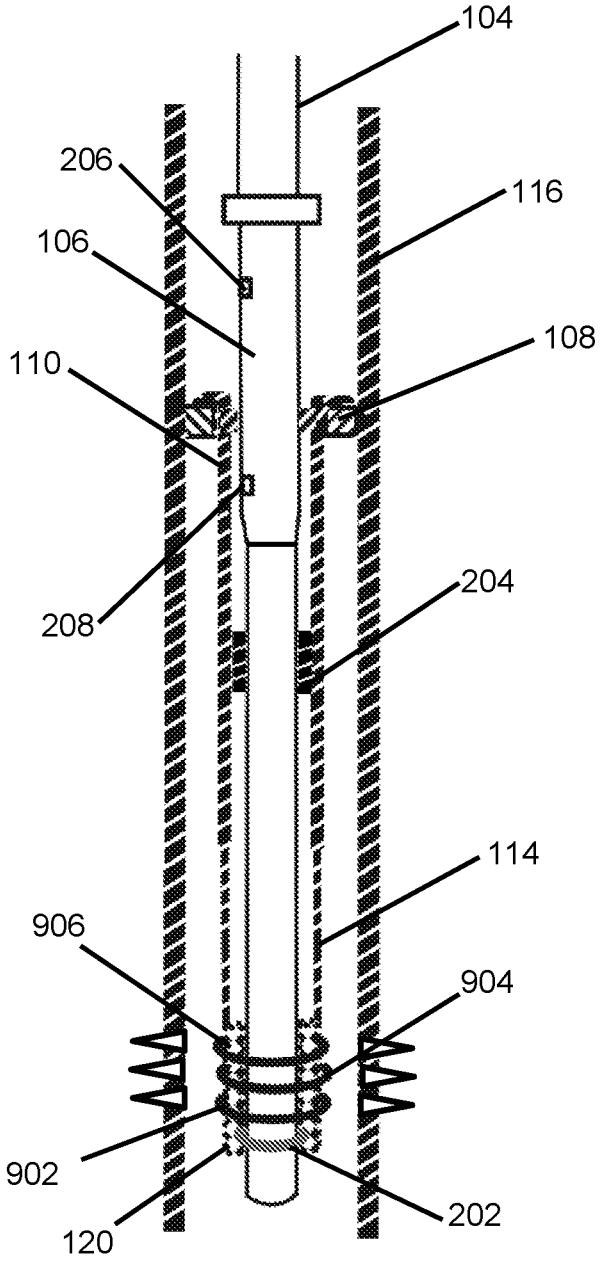
FIG. 9 illustrates a system for determining the position of the sand control service tool showing the sand control service tool in the circulating position according to another example embodiment.

FIG. 9 illustrates a system for determining the position of the sand control service tool 106 showing the sand control service tool in the circulating position according to another example embodiment. The sand control service tool 106 may be lowered to the circulating position shown in FIG. 9 in a similar manner as described above. In contrast to FIG. 2, multiple magnets 902, 904, 906 are attached to the sand screen 120. The magnets 902, 904, 906 are positioned above the sensor 202 when the sand control service tool is in the circulating position as shown in FIG. 9.

In some example embodiments, each of the magnets 902, 904, 906 may be attached to sand screen in a similar manner as described above with respect to the magnet 132. For example, the magnets 902, 904, 906 may be attached on the inside or outside of the sand screen 120. The magnets 902, 904, 906 may be attached to the sand screen 120 equally spaced from each other. Alternatively, the magnets 902, 904, 906 may be unevenly spaced. In some example embodiments, the magnets 902, 904, 906 are spaced from each other such that only one of the magnets 902, 904, 906 can be within the threshold distance from the sensor 202.

In some example embodiments, all of the magnets 902, 904, 906 may be spaced from the sensor 202 by more than the threshold distance such that the sensor is not triggered by the magnetic forces from the magnets 902, 904, 906 when the sand control service tool 106 is in the circulating position shown in FIG. 9. For example, the sensor 202 may indicate that the magnets 902, 904, 906 are outside of the threshold distance, for example, by sending position indicator information that indicates so or by the omitting to send position indicator information that indicates that one of the magnets 902, 904, 906 is within the threshold distance from the sensor 202.

In some example embodiments, when the sand control service tool 106 is in the circulating position shown in FIG.

9, the crossover port 208 is below the sand control packer 108. Slurry that is pumped down through the workstring 104 and the sand control service tool 106 enters the annulus between the sand screen 120 and the casing 116 through the crossover port 208 in a similar manner as described above.

In some alternative embodiments, when the sand control service tool 106 is in the circulating position, the sand control service tool 106 may be located lower or higher with respect to the service tool housing 110 than shown in FIG. 9. In some alternative embodiments, the sensor 202 and the magnets 902, 904, 906 may be separated by more or less distance than shown without departing from the scope of this disclosure. In some alternative embodiments, the magnets 902, 904, 906 may be separated from each other by more or less distance than shown without departing from the scope of this disclosure. In some example embodiments, more or fewer than three magnets may be attached to the sand screen 120 without departing from the scope of this disclosure.

Figure 10:
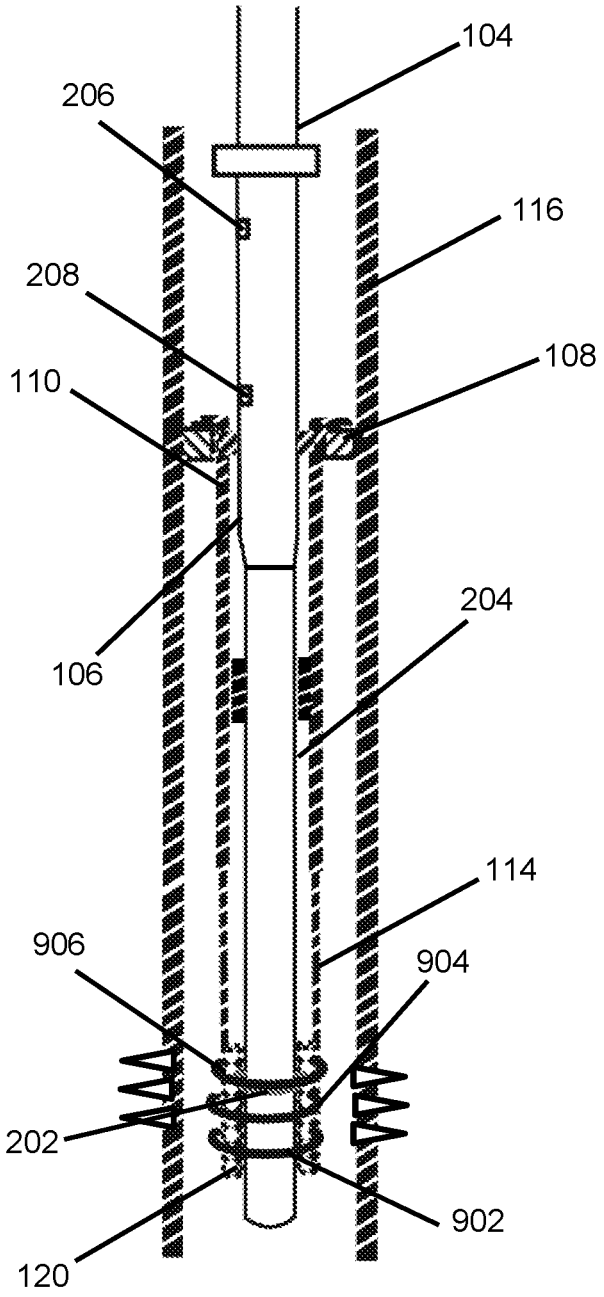
FIG. 10 illustrates the system of FIG. 9 with the sand control service tool in the reverse position according to another example embodiment.

FIG. 10 illustrates a system of FIG. 9 with the sand control service tool in the reverse position according to another example embodiment. As shown in FIG. 10, the crossover port 208 is located above the sand control packer 108 after the sand control service tool 106 has been raised to the reversion position from the circulating position shown in FIG. 9. Because the wash pipe 204 is raised along with the sand control service tool 106, the sensor 202 has moved closer to the magnet 906 in contrast to the location of the sensor 202 shown in FIG. 9.

In some example embodiments, in the reverse position of the sand control service tool 106 shown in FIG. 9, the magnet 906 may be within the threshold distance from the sensor 202 such that the sensor 202 is triggered by the magnetic force from the magnet 906. As illustrated in FIG. 9, the sensor 202 may not be horizontally aligned with the magnet 906 for the magnet 134 to come within the threshold distance from the sensor 202. In some alternative embodiments, the sensor 202 may need to be substantially horizontally aligned with the magnet 906 for the magnet 906 to be within the threshold distance from the sensor 202 and trigger the sensor 202.

In some example embodiments, to reach the position shown in FIG. 9, the sensor 202 passes the magnets 902 and 904 as the sensor 202 is raised along with the wash pipe 204 and the sand control service tool 106 from the circulating position shown in FIG. 9. To illustrate, starting from the position of the sensor 202 shown in FIG. 9, the sand control service tool 106 along with the wash pipe 204 and the sensor 202 may be continuously raised by an operator at the drillship 102. When the sand control service tool 106 is raised such that the magnet 902 comes within the threshold distance from the sensor 202, the sensor 202 may send the position indicator information that indicates that the magnet 902 is within the threshold distance from the sensor 202. To illustrate, the sensor 202 may not particularly identify the magnet 902 other than to indicate that the sensor 202 is triggered. Because the system is known to have the configuration of the magnets shown in FIGS. 9 and 10 and because it is known that the sand control service tool 106 is raised starting from the circulating position shown in FIG. 9, the first position indicator information that indicates the triggering of the sensor 202 is known to correspond to the magnet 902 coming with the threshold distance from the sensor 202.

As the sand control service tool 106 is further raised and the sensor 202 moves outside of the threshold distance from the magnet 902, the sensor 202 may no longer indicate that the magnet 902 (or any magnet) is within the threshold distance from the sensor 202. As the sand control service tool 106 is further raised such that the magnet 904 comes within the threshold distance from the sensor 202, and the sensor 202 may provide position indicator information that the magnet 904 is within the threshold distance in a similar manner as described with respect to the magnet 902.

As the sand control service tool 106 is further raised and the sensor 202 moves outside of the threshold distance from the magnet 904, the sensor 202 may no longer indicate that the magnet 902 (or any magnet) is within the threshold distance from the sensor 202. As the sand control service tool 106 is further raised such that the magnet 906 comes within the threshold distance from the sensor 202, and the sensor 202 may provide position indicator information that the magnet 906 is within the threshold distance. Because of the known arrangement of the magnets 902, 904, 906, the third indication of the triggering of the sensor 202 is interpreted as indicating that the sand control service tool 106 is in the desired reverse position such as shown in FIG. 10. Indicating that the sensor 202 is within threshold distance from the magnet 906 corresponds to indicating that the crossover port 208 of the sand control service tool 106 is above the sand control packer 108.

Upon the indication that the magnet 906 is within the threshold distance from the sensor 202, the operator at the drillship 102 may stop raising the sand control service tool 106. In some alternative embodiments, the sand control service tool 106 along with the wash pipe 204 and the sensor 202 may be raised in steps until the position indicator information indicates that the magnet 906 is within the threshold distance from the sensor 202.

In some example embodiments, the position indicator information may indicate that the magnets 902, 904, 906 are outside of the threshold distance from the sensor 202. For example, the absence of position indicator information indicating one of the magnets 902, 904, 906 is within the threshold distance from the sensor 202 may be interpreted as indicating that the magnets 902, 904, 906 are outside of the threshold distance. Alternatively, the position indicator information may more directly indicate that all of the magnets 902, 904, 906 are outside of the threshold distance whenever the sensor 202 is not triggered by a magnetic force. In some example embodiments, after the determination is made that the crossover port 208 is at a desired location above the sand control packer 108 (i.e., the sand control service tool 106 is in the reverse position), subsequent operations may be performed in a similar manner as described above.

In some alternative embodiments, when the sand control service tool 106 is in the reverse position, the sand control service tool 106 may be located lower or higher with respect to the service tool housing 110 than shown in FIG. 10. In some alternative embodiments, the sensor 202 and the magnets 902, 904, 906 may be separated by more or less distance than shown without departing from the scope of this disclosure. In some example embodiments, more or fewer than three magnets may be attached to the sand screen 120 without departing from the scope of this disclosure. In some alternative embodiments, some of the magnets 902, 904, 906 may be attached to the blank pipe 114 instead of to the sand screen 120 without departing from the scope of this disclosure. For example, the magnet 906 may be attached to the blank pipe 114 without departing from the scope of this disclosure.

Figure 11:
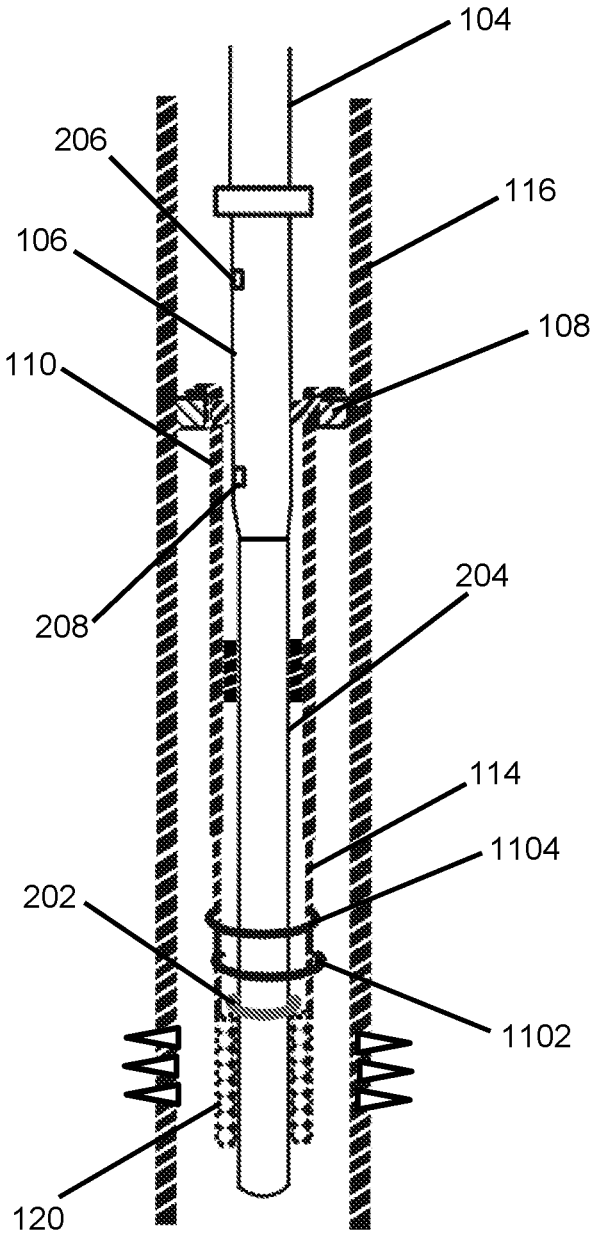
FIG. 11 illustrates a system for determining the position of the sand control service tool showing the sand control service tool in the circulating position according to another example embodiment.
Figure 12:
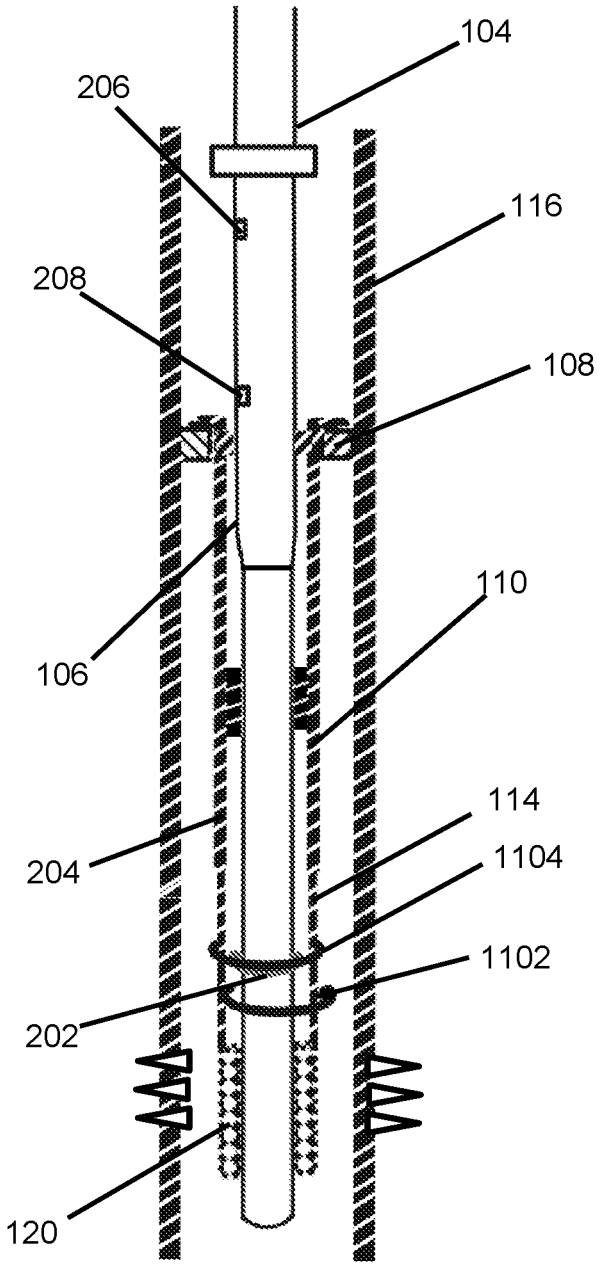
FIG. 12 illustrates the system of FIG. 11 with the sand control service tool in the reverse position according to another example embodiment.

FIG. 11 illustrates a system for determining the position of the sand control service tool showing the sand control service tool is in the circulating position according to another example embodiment. FIG. 12 illustrates the system of FIG. 11 with the sand control service tool is in the reverse position according to another example embodiment. The system shown in FIGS. 11 and 12 corresponds to the system shown in FIGS. 9 and 10 with the primary difference that magnets 1102, 1104 are attached to the blank pipe 114 in contrast to the magnets 902, 904, 906 that are attached to the sand screen 120. In FIGS. 11 and 12, each of the magnets 1102, 1104 may be attached to the blank pipe 114 in a similar manner as described above with respect to the magnet 134.

In some alternative embodiments, when the sand control service tool 106 is in the circulating position or in the reverse position, the sand control service tool 106 may be located lower or higher with respect to the service tool housing 110 than shown in FIGS. 11 and 12 without departing from the scope of this disclosure. In some alternative embodiments, the sensor 202 and the magnets 1102, 1104 may be separated by more or less distance than shown without departing from the scope of this disclosure. In some alternative embodiments, the 1102, 1104 may be separated from each other by more or less distance than shown without departing from the scope of this disclosure. In some example embodiments, more or fewer than two magnets may be attached to blank pipe 114 without departing from the scope of this disclosure. In some alternative embodiments, the magnet 1102 may be attached to the sand screen 120 instead of to the blank pipe 114 without departing from the scope of this disclosure.

Figure 13:
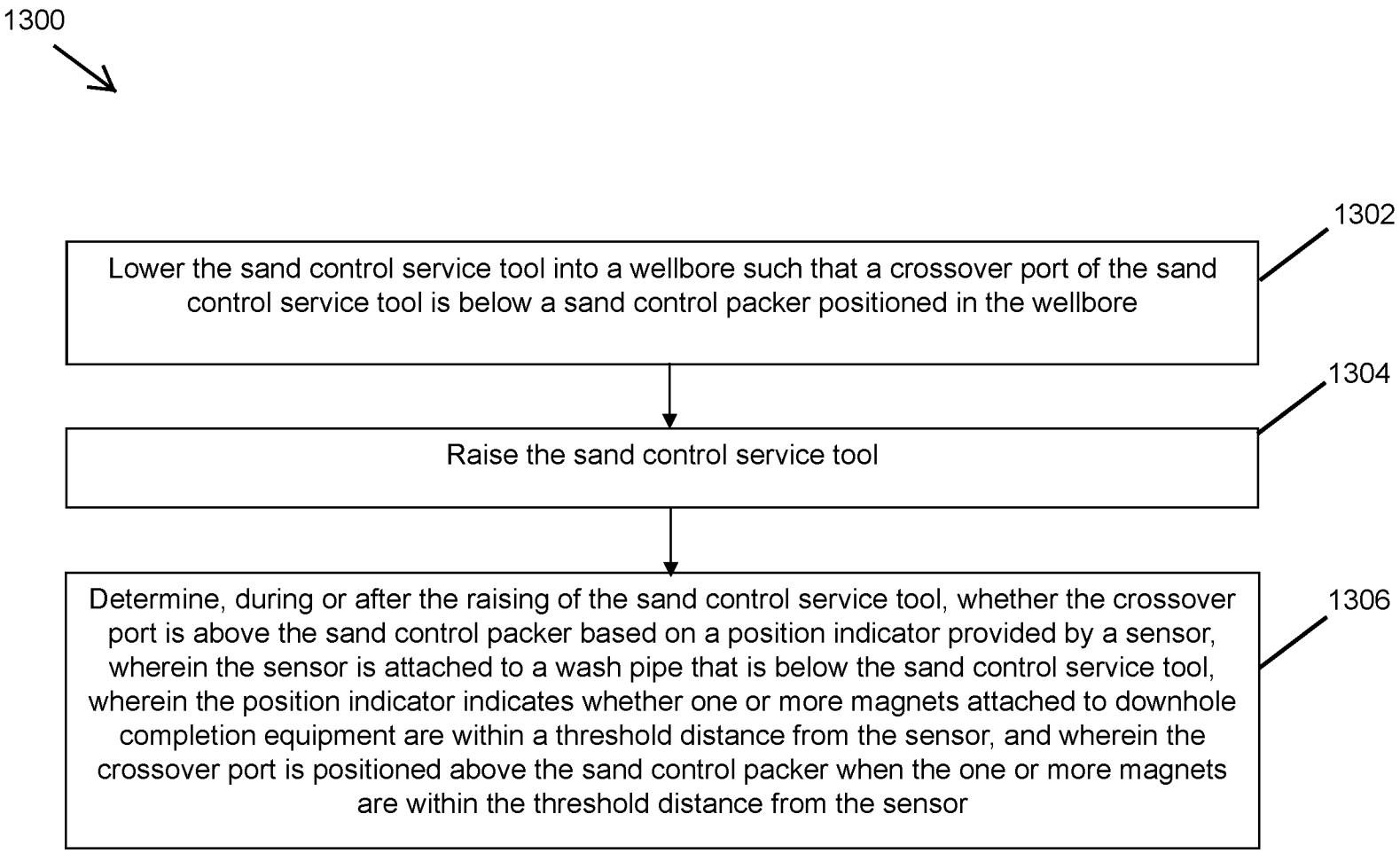
FIG. 13 illustrates a method of determining positions of a sand control service tool in deep water operations according to an example embodiment.

FIG. 13 illustrates a method 1300 of determining positions of a sand control service tool in deep water operations according to an example embodiment. Referring to FIGS. 1-13, in some example embodiments, the method 1300 includes, at step 1302, lowering the sand control service tool 106 into the wellbore 126 such that the crossover port 208 of the sand control service tool 106 is below the sand control packer 108 positioned in the wellbore 126. At step 1304, the method 1300 may include raising the sand control service tool 106. For example, the sand control service tool 106 may be raised continuously or in steps as described above. At step 1306, determining, during or after the raising of the sand control service tool, whether the crossover port 208 is above the sand control packer based on the position indicator information provided by the sensor 202. As described above, the sensor 202 is attached to the wash pipe 204 that is below the sand control service tool. The position indicator information indicates whether one or more magnets attached to downhole completion equipment, such as the sand screen 120 and/or the blank pipe 114, are within a threshold distance from the sensor 202. In some example embodiments, the method 1300 includes transmitting the position indicator information to the drillship 102. The crossover port is positioned above the sand control packer 108 when the one or more magnets are within the threshold distance from the sensor 202.

In some example embodiments, the method 1300 includes, after lowering the sand control service tool 106 into the wellbore 106, pumping slurry through the sand control service tool 106 into a portion of the wellbore below the sand control packer 108. The slurry exits the sand control service tool 106 through the crossover port 208. In some example embodiments, the method 1300 includes stopping the raising of the sand control service tool in response to the position indicator information indicating that the one or more magnets 132, 134, 906, or 1102 are within the threshold distance from the sensor 202.

Although particular order and steps of the method 1300 are described above, some of the steps may be performed in a different order or may be omitted without departing from the scope of this disclosure. Further, in some embodiments, the method 1300 may include other steps in addition to the steps described above.

Although some embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures. One of ordinary skill in the art will appreciate that in the development of any such actual embodiment, numerous implementation-specific decisions must be made to achieve the developers' specific goals, such as compliance with system-related constraints, which will vary from one implementation to another. Moreover, it will be appreciated that such a development effort might be complex and time-consuming, but would nevertheless be a routine undertaking for those of ordinary skill in the art having the benefit of this disclosure.

What is claimed is:

1. A system for determining positions of a sand control service tool, the system comprising:

a wash pipe positioned below the sand control service tool;

a sensor attached to the wash pipe; and one or more magnets attached to downhole completion equipment and positioned around the wash pipe, wherein the sensor is configured to generate position indicator information that indicates whether the one or more magnets are within a threshold distance from the sensor and wherein a crossover port of the sand control service tool is positioned above a sand control packer when the one or more magnets are within the threshold distance from the sensor.

2. The system of claim 1, wherein the sensor includes a reed switch that is triggered by a magnetic force from the one or more magnets when the one or more magnets are within the threshold distance from the sensor.

3. The system of claim 2, wherein the reed switch is normally open and wherein the reed switch is configured to close in response to the magnetic force from the one or more magnets when the one or more magnets are within the threshold distance from the sensor.

4. The system of claim 2, wherein the reed switch is normally closed and wherein the reed switch is configured to open in response to the magnetic force from the one or more magnets when the one or more magnets are within the threshold distance from the sensor.

5. The system of claim 1, wherein the wash pipe is attached to and moves along with the sand control service tool.

6. The system of claim 1, wherein the downhole completion equipment includes a sand screen and wherein the one or more magnets are attached to the sand screen.

7. The system of claim 1, wherein the downhole completion equipment includes a blank pipe and wherein the one or more magnets are attached to the blank pipe.

8. A method of determining positions of a sand control service tool, the method comprising:

lowering the sand control service tool into a wellbore such that a crossover port of the sand control service tool is below a sand control packer positioned in the wellbore;

raising the sand control service tool; and determining, during or after the raising of the sand control service tool, whether the crossover port is above the sand control packer based on position indicator information provided by a sensor, wherein the sensor is attached to a wash pipe that is below the sand control service tool, wherein the position indicator information indicates whether one or more magnets attached to downhole completion equipment and positioned around the wash pipe are within a threshold distance from the sensor, and wherein the crossover port is positioned above the sand control packer when the one or more magnets are within the threshold distance from the sensor.

9. The method of claim 8, wherein the sensor includes a reed switch that reacts to a magnetic force from the one or more magnets when the one or more magnets are within the threshold distance from the sensor.

10. The method of claim 9, wherein the reed switch is a normally open and wherein the reed switch is configured to close in response to the magnetic force from the one or more magnets when the one or more magnets are within the threshold distance from the sensor.

11. The method of claim 9, wherein the reed switch is normally closed and wherein the reed switch is configured to open in response to the magnetic force from the one or more magnets when the one or more magnets are within the threshold distance from the sensor.

12. The method of claim 8, wherein the wash pipe is attached to and moves along with the sand control service tool.

13. The method of claim 8, wherein the downhole completion equipment includes a sand screen and wherein the one or more magnets are attached to the sand screen.

14. The method of claim 8, wherein the downhole completion equipment includes a blank pipe and wherein the one or more magnets are attached to the blank pipe.

15. The method of claim 8, further comprising, after lowering the sand control service tool into the wellbore, pumping slurry through the sand control service tool into a portion of the wellbore below the sand control packer, wherein the slurry exits the sand control service tool through the crossover port.

16. The method of claim 8, further comprising transmitting the position indicator information to a drillship.

17. The method of claim 8, further comprising stopping the raising of the sand control service tool in response to the position indicator information indicating that the one or more magnets are within the threshold distance from the sensor.

18. A system for determining positions of a sand control service tool in offshore operations, the system comprising:

a wash pipe positioned below the sand control service tool;

a sensor attached to the wash pipe;

first one or more magnets attached to downhole completion equipment, the first one or more magnets positioned around the wash pipe; and second one or more magnets attached to the downhole completion equipment below the first one or more magnets, the second one or more magnets positioned around the wash pipe, wherein the sensor is configured to:

detect a first magnetic force from the first one or more magnets;

detect a second magnetic force from the second one or more magnets; and generate a position indicator that indicates whether the first one or more magnets are within a first threshold distance from the sensor and whether the second one or more magnets are within a second threshold distance from the sensor, wherein a crossover port of the sand control service tool is positioned above a sand control packer when the first one or more magnets are within the first threshold distance from the sensor and wherein the crossover port of the sand control service tool is positioned below the sand control packer when the second one or more magnets are within the second threshold distance from the sensor.

19. The system of claim 18, wherein the sensor includes a reed switch configured to react to a first magnetic force from the first one or more magnets when the first one or more magnets are within the first threshold distance from the sensor and to react to a second magnetic force when the second one or more magnets are within the second threshold distance from the sensor.

20. The system of claim 18, wherein the downhole completion equipment includes a sand screen and a blank pipe and wherein the first one or more magnets and the second one or more magnets are attached to the sand screen or to the blank pipe.

* * * * *